US010829970B2

(12) United States Patent
Ehrlich et al.

(10) Patent No.: US 10,829,970 B2
(45) Date of Patent: Nov. 10, 2020

(54) OVERHEAD DOOR HEADER WITH MAXIMUM CLEARANCE

(71) Applicant: Wabash National, L.P., Lafayette, IN (US)

(72) Inventors: Rodney P. Ehrlich, Monticello, IN (US); Michael L. Thoma, Lafayette, IN (US)

(73) Assignee: Wabash National, L.P., Lafayette, IN (US)

( * ) Notice: Subject to any disclaimer, the term of this patent is extended or adjusted under 35 U.S.C. 154(b) by 211 days.

(21) Appl. No.: 15/837,581

(22) Filed: Dec. 11, 2017

(65) Prior Publication Data

US 2018/0171692 A1 Jun. 21, 2018

Related U.S. Application Data

(60) Provisional application No. 62/435,194, filed on Dec. 16, 2016.

(51) Int. Cl.

| | |
|---|---|
| ***E05D 13/00*** | (2006.01) |
| ***E05B 65/00*** | (2006.01) |
| *E05D 15/24* | (2006.01) |
| *E05B 39/04* | (2006.01) |

(52) U.S. Cl.

CPC ..... *E05D 13/1261* (2013.01); *E05B 65/0021* (2013.01); *E05B 39/04* (2013.01); *E05D 15/242* (2013.01); *E05Y 2600/12* (2013.01); *E05Y 2800/352* (2013.01); *E05Y 2800/356* (2013.01); *E05Y 2800/358* (2013.01); *E05Y 2900/516* (2013.01); *E05Y 2900/532* (2013.01)

(58) Field of Classification Search

CPC . E05D 13/1261; E05D 13/1253; E05D 13/12; E06B 9/1703; E06B 9/17023; E06B 9/17015; E06B 9/17007; E05Y 2900/516

See application file for complete search history.

(56) References Cited

U.S. PATENT DOCUMENTS 3,412,423 A * 11/1968 Binns ..... E05D 13/1261 16/198
4,882,806 A 11/1989 Davis
4,981,165 A 1/1991 Miller et al.

(Continued)

FOREIGN PATENT DOCUMENTS

EP 2636839 A2 * 9/2013

OTHER PUBLICATIONS

Friedl, EP-2636839; Machine translation retrieved from https://worldwide.espacenet.com/publicationDetails/biblio?CC=EP&NR=2636839A2&KC=A2&FT=D&ND=3&date=20130911&DB=&locale=en EP (Year: 2013).*

*Primary Examiner* — Katherine W Mitchell
*Assistant Examiner* — Abe Massad
(74) *Attorney, Agent, or Firm* — Quarles & Brady LLP

(57) ABSTRACT

Embodiments of the invention provide a header for enclosing a counterbalance assembly for use with an overhead door assembly. The header comprises a top surface, a rear surface coupled to a rear end of the top surface, a bottom surface coupled to a bottom end of the rear surface, and at least one reinforcement member disposed rearward of the counterbalance assembly and forward of the rear surface. The at least one reinforcement member provides necessary reinforcement to the header while allowing for a vertical height of the header to be minimized.

20 Claims, 5 Drawing Sheets

(56) References Cited

U.S. PATENT DOCUMENTS

| | | | | | |
|---|---|---|---|---|---|
| 5,768,828 | A * | 6/1998 | Wilson | B60P 1/438 | 49/197 |
| 5,865,235 | A | 2/1999 | Krupke et al. | | |
| 6,125,582 | A * | 10/2000 | Mondragon | E05D 13/1261 | 160/200 |
| RE39,504 | E * | 3/2007 | Scates | E05D 13/1261 | 160/191 |
| 9,631,421 | B2 * | 4/2017 | Cheng | E06B 9/42 | |
| 10,190,365 | B1 * | 1/2019 | McSparrin | E06B 9/42 | |
| 2008/0314533 | A1 | 12/2008 | Park | | |
| 2012/0125545 | A1 * | 5/2012 | Ehrlich | B60J 5/14 | 160/229.1 |
| 2012/0151714 | A1 | 6/2012 | Szczgielski | | |
| 2015/0152683 | A1 * | 6/2015 | Lu | E06B 9/56 | 160/323.1 |
| 2016/0221423 | A1 * | 8/2016 | Barton | B60J 5/14 | |

* cited by examiner

OVERHEAD DOOR HEADER WITH MAXIMUM CLEARANCE

CROSS REFERENCE TO RELATED APPLICATIONS

This application claims the benefit of U.S. Provisional Application Ser. No. 62/435,194, filed on Dec. 16, 2016, and entitled "Max Clearance Overhead Door Heater," the entire contents of which are incorporated by reference herein.

BACKGROUND

Many storage containers, such as large truck trailers, portable storage containers, and garages, for example, include an overhead door constructed from panels hingedly joined together and supported by rollers that ride in a pair of door guide tracks. The weight of the door may be balanced by a counterbalance mechanism including either a torsion spring system or a pair of extension springs, for example. The counterbalance mechanism is typically mounted on a header wall above the overhead door of the trailer. The guide tracks are typically positioned on outer sidewalls of the trailer and extend vertically upward from a floor of the opening to a top of the opening, where they then extend backward in a horizontal direction slightly below a roof of the storage container. During operation, the rollers of the overhead door travel within the guide tracks and allow the door to be moved between a closed, vertical position and an opened, horizontal position.

SUMMARY

Some embodiments of the invention provide a truck trailer comprising an overhead door assembly including a door opening having a first height and at least one door panel moveable between an open position and a closed position, a counterbalance assembly configured to aid in moving the at least one door panel between the open position and the closed position, and a header having a second height and enclosing the counterbalance assembly and including a top surface, a rear surface coupled to a rear end of the top surface, a bottom surface coupled to a bottom end of the rear surface, and at least one reinforcement member disposed rearward of the counterbalance assembly and forward of the rear surface, the second height being less than about 5% of the first height and the reinforcement member provides necessary reinforcement to the header while allowing for the second height to be minimized, thereby maximizing the first height.

Some embodiments of the invention provide a truck trailer comprising an overhead door assembly including a door opening and at least one door panel moveable between an open position and a closed position, a counterbalance assembly configured to aid in moving the at least one door panel between the open position and the closed position, the counterbalance assembly being supported by a shaft, and a header enclosing the counterbalance assembly and including a top surface, a rear surface coupled to a rear end of the top surface, a bottom surface coupled to a bottom end of the rear surface, first and second reinforcement members disposed rearward of the counterbalance assembly and forward of the rear surface, the first and second reinforcement members being substantially parallel to the rear surface and extending toward a center of the header, and first and second shaft support members coupled to and spaced inwardly from ends of the bottom surface and substantially perpendicular to the rear surface, first and second ends of the shaft being coupled to the first and second shaft support members, respectively.

Some embodiments of the invention provide a header for enclosing a counterbalance assembly for use with an overhead door assembly, the header comprising a top surface, a rear surface coupled to a rear end of the top surface, a bottom surface coupled to a bottom end of the rear surface, and at least one reinforcement member disposed rearward of the counterbalance assembly and forward of the rear surface, the at least one reinforcement member providing reinforcement to the header while allowing for a vertical height of the header to be minimized.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
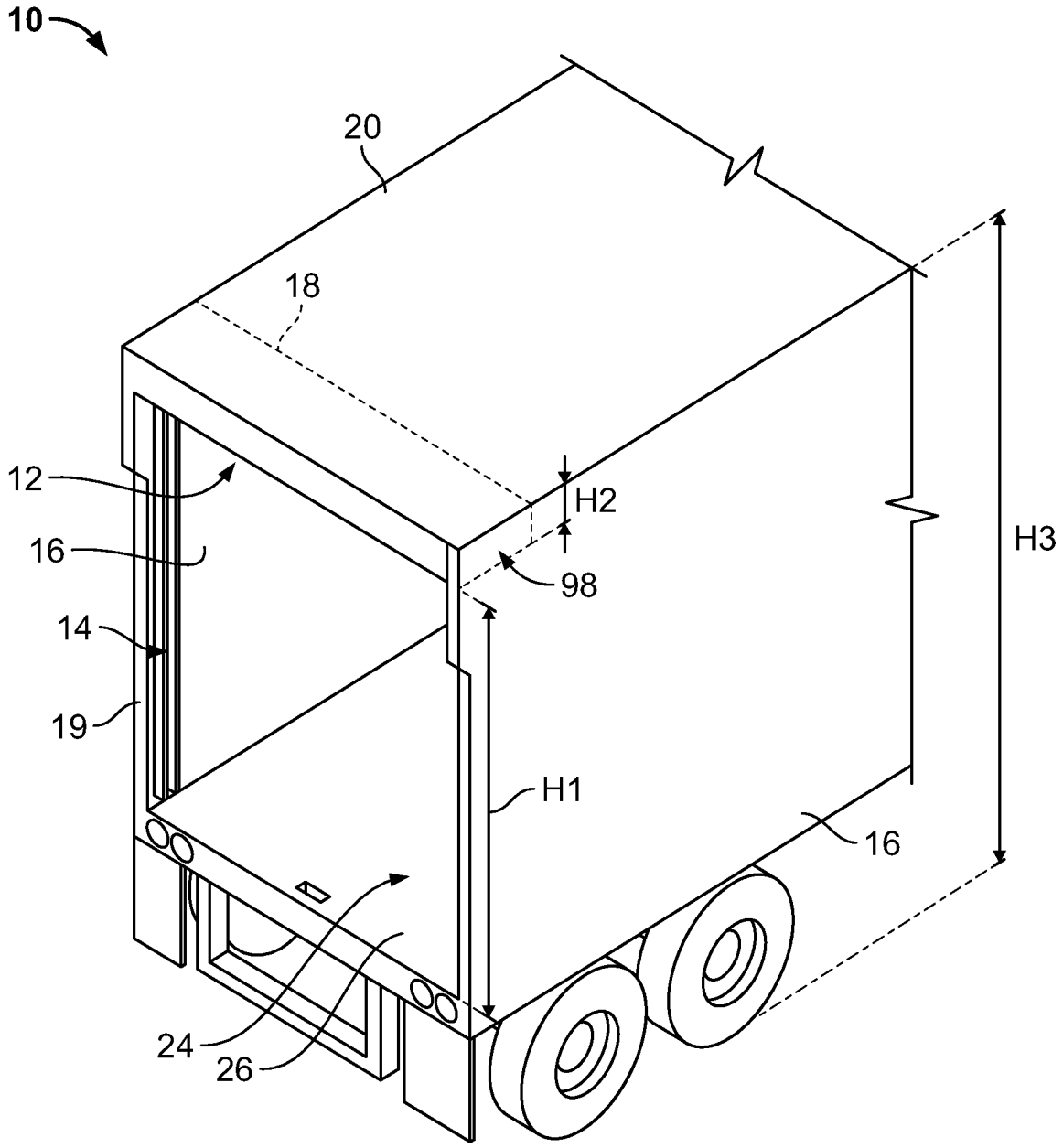
FIG. 1 is a rear, perspective view of a portion of a truck trailer including an overhead door assembly and showing a door of the assembly in an opened or horizontal position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

For the purposes of promoting an understanding of the principles of the invention, reference will now be made to illustrative embodiments shown in the attached drawings and specific language will be used to describe the same. While the concepts of this disclosure are described in relation to a truck trailer, it will be understood that they are equally applicable to other mobile or stationary storage enclosures or containers, as well as refrigerated and unrefrigerated trailers, storage containers, or truck bodies which include an overheard door assembly.

As used herein, directional terms including "top," "bottom," "side," "horizontal," "vertical," and so on are used to indicate directional relationships with respect to an arbitrary reference frame (e.g., a reference frame of a particular figure or figures). These directional terms are used consistently relative to a particular embodiment. For example, a "top" feature of an embodiment is opposite a corresponding "bottom" feature, and a "horizontal" feature generally extends perpendicularly to a "vertical" feature. However, unless otherwise defined or limited, these directional terms are not intended to indicate an absolute reference frame for a particular cart assembly. For example, in some embodiments, a "horizontal" feature of a truck trailer, while generally perpendicular to a "vertical" feature of the truck trailer, may not necessarily extend in a strictly horizontal direction relative to ground.

FIG. 1 illustrates a truck trailer 10, according to one embodiment of the invention. The truck trailer 10 includes an overhead door assembly 12 (shown in FIG. 2) at the rear of the trailer 10. The overhead door assembly 12 includes two guide track systems 14 each coupled to one of two sidewalls 16 of the trailer 10, a rotational counterbalance assembly 18, and an overhead door 22 (shown in FIG. 2) coupled to both the guide track systems 14 and the counterbalance assembly 18.

The guide track systems 14 illustrated may be similar to the guide track system disclosed in U.S. patent application Ser. No. 13/113,144 entitled OVERHEAD DOOR ASSEMBLY FOR A STORAGE CONTAINER which was filed on May 23, 2011, the entirety of which is hereby expressly incorporated by reference herein. As such, a more detailed discussion of the structure and operation of the guide track systems 14 can be found therein.

The overhead door 22 operates to close a rear door opening 24 of the trailer 10 defined by the sidewalls 16, a floor 26 of the trailer 10, and a roof 20 of the trailer 10. The overhead door 22 is movable relative to the guide track systems 14 between a vertical, fully closed position (as shown in FIG. 2) and a horizontal, fully opened position (as shown in FIG. 1).

Figure 2:
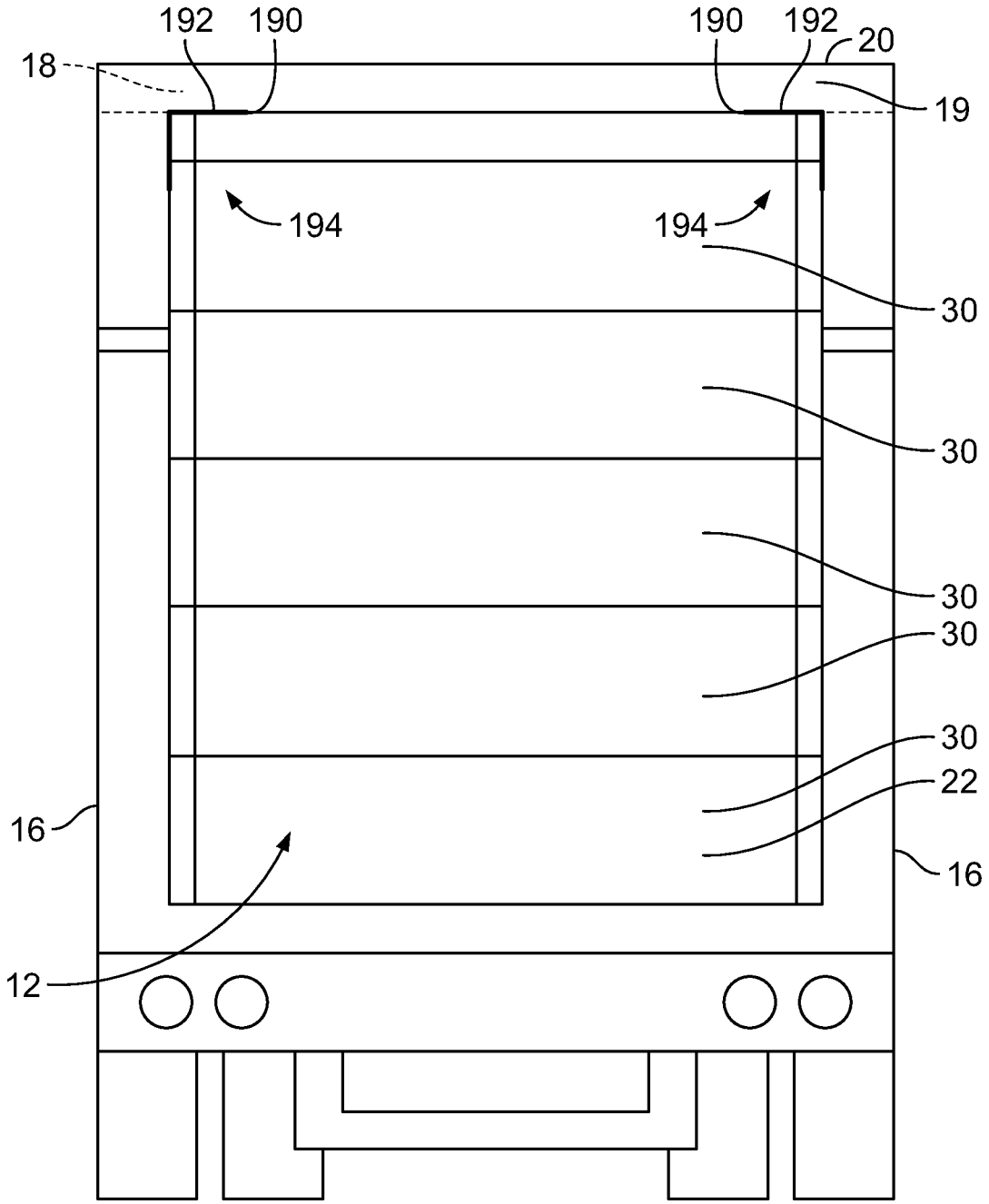
FIG. 2 is a rear elevational view of the truck trailer of FIG. 1 with the door in a closed or vertical position.

Referring now to FIG. 2, the overhead door 22 includes a plurality of lateral panels 30 coupled together by hinges (not shown) coupled to upper and lower edges thereof and further including rollers (also not shown) coupled to outer edges thereof. The rollers are configured to roll within the track systems 14, to allow the door 22 to move along the track systems 14 between the opened and closed positions. In other words, the lateral panels 30 are disposed one on top of the other with each panel 30 hinged to at least one adjacent panel 30. Additionally, the bottom panel 30 of the door 22 includes a bottom roller assembly (not shown) coupled to outer edges thereof and configured to allow for the bottom panel 30 of the door 22 to be moved completely into the horizontal position above the rear door opening 24 of the trailer 10 when the door is opened. This bottom roller assembly is similar to the bottom roller assembly disclosed in U.S. patent application Ser. No. 13/301,471 entitled HINGED BOTTOM ROLLER ASSEMBLY AND COUNTERBALANCE MECHANISM FOR OVERHEAD DOOR which was filed on Nov. 21, 2011, the entirety of which is hereby expressly incorporated by reference herein. As such, a more detailed discussion of the structure and operation of the bottom roller assembly can be found therein.

As is generally understood by one skilled in the art, overhead doors require a counterbalancing force which allows for the door to be more easily moved between the opened and closed positions. Such counterbalancing force for the overhead door assembly 12 of the present disclosure is provided by the illustrative counterbalance assembly 18.

Figure 3:
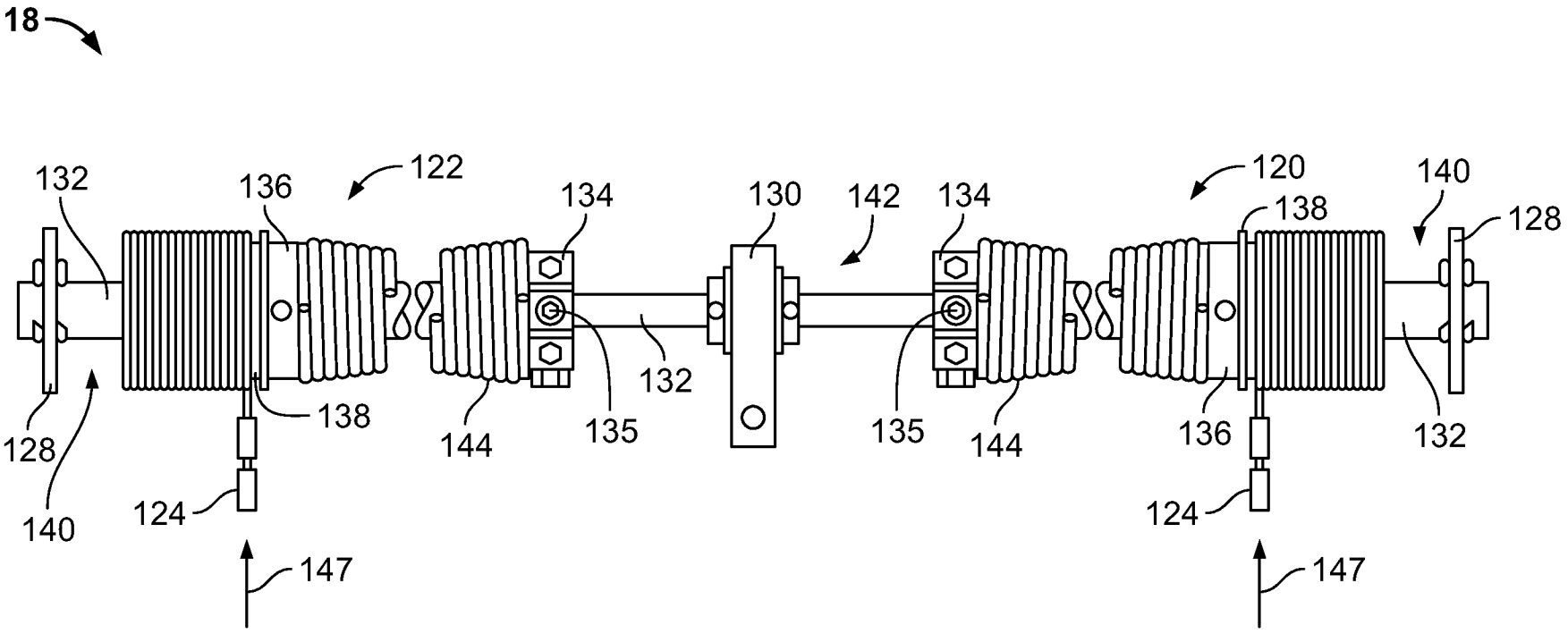
FIG. 3 is a bottom view of an exemplary counterbalance mechanism of the overhead door assembly of FIG. 1.

As shown in FIG. 3, an exemplary counterbalance assembly 18 includes a counterbalance mechanism 120 positioned on the right and a counterbalance mechanism 122 positioned on the left. Illustratively, the counterbalance mechanism 122 is the same as the counterbalance mechanism 120; as such, only the counterbalance mechanism 120 is described herein. The counterbalance mechanism 120 is supported by a bracket 128 at one end 140 and by an adjustment mechanism 130 at a center 142 of the counterbalance assembly 18. The adjustment mechanism 130 is anchored to a rear surface 178 of a header 98 (FIG. 4) and supports a shaft 132 of the counterbalance mechanism 120 thereon. The counterbalance mechanism 120 includes the shaft 132 supported by the adjustment mechanism 130, a stationary cone 134, or spline, coupled to the adjustment mechanism 130 via the shaft 132, and a cable drum 138 having a winding cone 136 thereon. Illustratively, the stationary cone 134 is integral with the winding cone 136 of the cable drum 138. The cable drum 138 and the winding cone 136 rotate relative to the shaft 132. Thus, as the cable 124 is extended, a torsion spring 144 is deflected and develops a counterbalance force 147. The cables 124 of each counterbalance mechanism 120, 122 are attached to the bottom panel 30 of the door 22. It should be understood, that the cables 124 may be coupled directly to the bottom door panel 30 and/or may be coupled to any suitable location on or connecting to the bottom door panel 30. As such, the counterbalance forces 147 imposed on the cables 124 assist in supporting the door 22.

Figure 4:
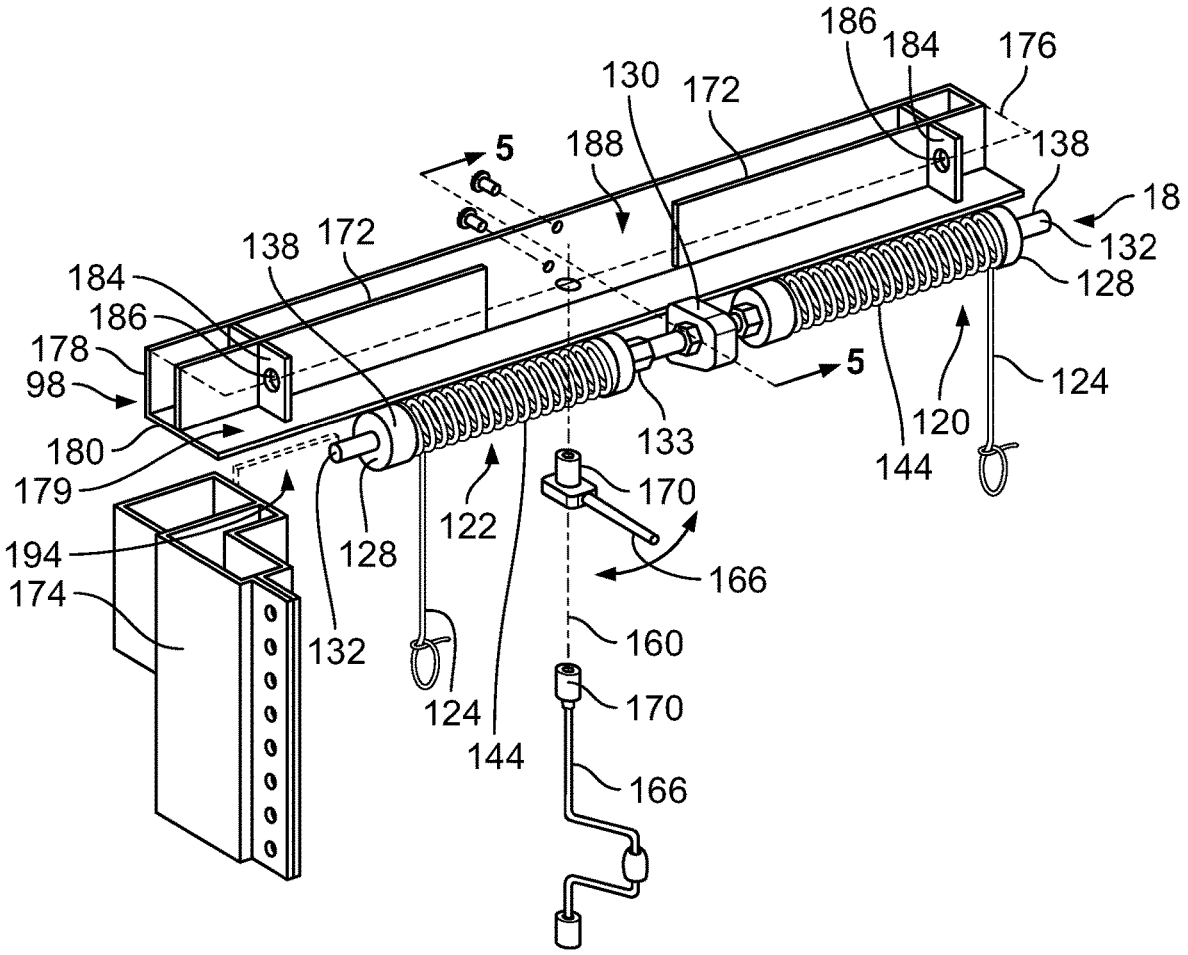
FIG. 4 is an exploded perspective view of the counterbalance mechanism of FIG. 3, shown within a header of the truck trailer of FIG. 1.
Figure 5:
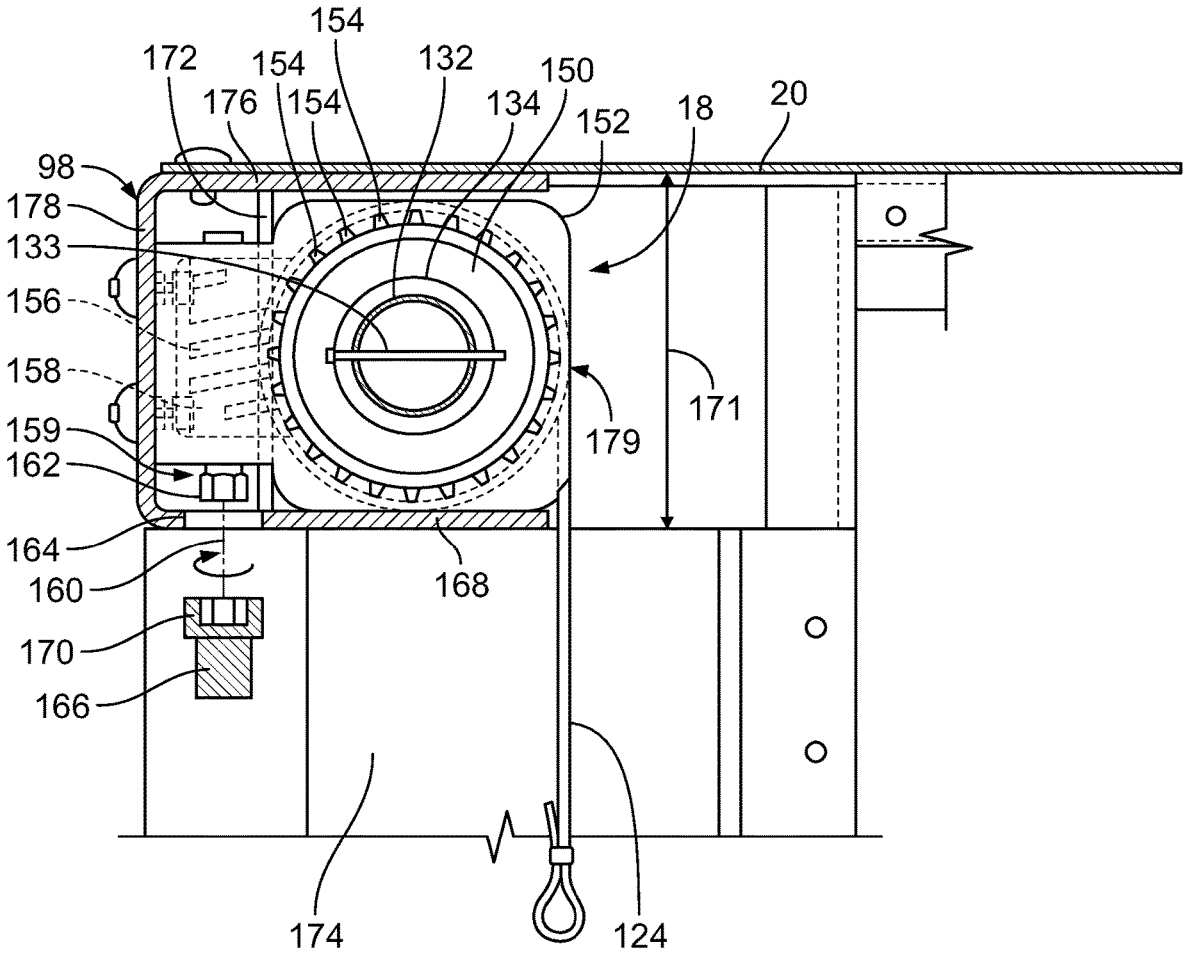
FIG. 5 is a cross-sectional view of the counterbalance mechanism of FIG. 4 with the counterbalance shown installed within the header and taken generally along the lines 5-5 of FIG. 4.

As shown in FIGS. 4 and 5, the counterbalance assembly 18 is contained within a counterbalancing housing, or header 98. The header 98 is coupled to and extends downwardly from an inside surface of the roof 20 of the trailer 10. As illustrated, the counterbalance assembly 18 is contained within the header 98 such that the header 98 surrounds and at least partially encloses the counterbalance assembly 18. Illustratively, the header 98 extends laterally across the width of the trailer 10. The header 98, and thus the counterbalance assembly 18 contained therein, is further positioned adjacent an upper rear wall 19 of the trailer 10. Additionally, the counterbalance assembly 18 is located rearward of the door 22 when the door 22 is in the horizontal, opened position.

Referring specifically to FIG. 5, the adjustment mechanism 130 includes an adjuster body 152 that houses and supports a pinion 150 and a worm gear 158. The adjuster body 152 is coupled to and supported by the rear surface 178 of the header 98 within the header 98. The pinion 150 is rotatable within the adjuster body 152 and includes helical teeth 154 on an outer periphery that engage teeth 156 of the worm gear 158. Rotation of the worm gear 158 about an axis 160 causes the teeth 156 to act on the teeth 154 to rotate the pinion 150 about a longitudinal axis of the shaft 132.

The worm gear 158 includes a pin 159 disposed along a longitudinal axis thereof. The pin 159 includes a hex-shaped head 162 that may be engaged by a driver, or worm gear adjuster 166, which may be inserted through an aperture 164 formed in a bottom surface 168 of the header 98 to permit a user to rotate the worm gear 158. The pin 159 is secured within an aperture (not shown) to the adjuster body 152 via a fastener, or pin (not shown) in order to secure the worm gear 158 within the adjuster body 152. The pin 159 is additionally configured to rotate within the adjuster body 152. The pin 159 further includes a flat portion (not shown) which, in use, is aligned with a flat portion (also not shown) within the worm gear 158. Accordingly, rotation of the pin 159 operates to rotate the worm gear 158 therewith.

The pinion 150 of the adjustment mechanism 130 is anchored to the shaft 132 via a pin 133 such that the shaft 132 and the pinion 150 rotate together. One or more set screws 135 are provided on each cone 134 (shown in FIG. 3) in order to lock the cone 134 against the shaft 132 such that rotation of the shaft 132 operates to rotate each cone 134. Thus, rotation of the pin 159 by the worm gear adjuster 166 operates to rotate the worm gear 158. In turn, rotation of the worm gear 158 rotates the pinion 150 of the adjustment mechanism 130. As noted above, the shaft 132, which is rotated with the pinion 150, then rotates the cones 134 and thereby operates to tension the spring 144 associated with each cable drum 138.

The adjuster 166 includes a head 170 able to receive the hex-shaped head 162 of the pin 159 in order to rotate the hex-shaped head 162. It is within the scope of this disclosure to include other adjusters having other suitably-shaped heads configured for engaging the head 162 of the pin 159 in order to rotate the pin 159 and the worm gear 158. In use, a user may then stand generally in the rear opening 24 of the trailer 10 and insert the adjuster 166 through the bottom surface 168 of the header 98 to engage the pin 159 and head 162 associated with the worm gear 158 in order to rotate the worm gear 158 as needed. Additionally, as shown in FIG. 4, the adjuster 166 can be a handheld socket wrench, a two-handed socket speed wrench, or any other suitable adjuster.

Rotation of the worm gear 158 allows a user to adjust the pre-load of the torsion spring 144 (shown in FIG. 3) to adjust the counterbalance force 147. The static friction of the interaction between the worm gear 158 and pinion 150 is sufficient to resist the torsional force of the torsion spring 144 such that adjustment of the position of the pinion 150 relative to the adjuster body 152 is maintained by the frictional force. Thus, the adjustment mechanism 130 is self-locking in that an additional lock is not necessary to prevent the worm gear 158, pinion 150, and cone 134 from rotating backwards, or back driving. The counterbalance mechanism 122 is a mirror image to the counterbalance 120 and thus includes the same components and operates in a similar manner.

In use, the overhead door assembly 12 operates to allow the door 22 to move between the fully closed, vertical position to the opened, horizontal position (and positions in between). When the door 22 is raised and moved toward the fully opened position, the torsion spring 144 of the counterbalance assembly 18 unwinds such that stored tension in the torsion spring 144 operates to help lift the door 22 by turning the shaft 132, thus turning the cable drums 138 in the counterclockwise direction shown in FIGS. 4 and 5 in order to wrap the cable 124 around cable-receiving grooves in the cable drum 138. In other words, the counterbalance assembly 18 is used to help lift the weight of the door 22 by providing the counterbalance force 147 to the cable 124 which operates to pull the bottom end of the door 22 vertically along the guide track system 14. As such, when the door 22 is lowered, the cable 124 unwraps from the drum 138 and the torsion spring 144 is rewound about the shaft 132 to full tension.

During transit, the truck trailer 10 experiences significant torsional stresses when it traverses non-level terrain (e.g., pot-holes, uneven roadways, roadway debris, etc.). To prevent cracking in the corners of the truck trailer 10, a forged foot angle 194 (best illustrated in FIG. 2) is included in the corners of the truck trailer 10. When the forged foot angle 194 is put under torsional stress during transit, it imposes a significant force on the header 98. As such, the header 98 must be able to withstand the force imposed thereon by the forged foot angle 194 during transit. During use, it is also preferable to maximize a height H1 of the door opening 24. Due to height restrictions of the truck trailer 10, a height of the roof 20 of the truck trailer 10 is limited. As such, it is preferable to minimize a vertical height 171 of the header 98, thereby maximizing the height H1 of the door opening 24. In some embodiments, a maximum height H3 of the trailer may be about 162 inches and a height H2 of the header 98 may be about 4 inches. In such embodiments, the floor 26 may be a distance about 48 inches from the ground, which would make the door opening 24 about 110 inches. In some embodiments, the height H2 of the header may be less than about 5% of the height H1 of the door opening, or less than about 4% of the height H1 of the door opening, or about 3.6% of the height H1 of the door opening. In some embodiments, the height H2 of the header may be less than about 4% of a height H3 of the trailer, less than about 3% of the height H3 of the trailer or about 2.5% of the height H3 of the trailer.

As will be discussed below, the vertical height 171 of the header 98 is minimized by providing reinforcement members 172, within the header 98 and rearward of the counterbalance assembly 18, which provide necessary reinforcement to the header 98 allowing the header 98 to withstand the force imposed thereon by the forged foot angle 194 during transit. The reinforcement members 172 allow the counterbalance assembly 18 to be arranged in the shallowest possible vertical orientation, while still providing necessary structural rigidity and allowing access to the counterbalance assembly 18. As such, the vertical height 171 of the header 98 is only slightly larger than a diameter of the fully wound cable drum 138.

As shown in FIGS. 4 and 5, the header 98 of the truck trailer 10 spans between the sidewalls 16, is disposed above corner post assemblies 174, and is coupled to the sidewalls 16, the roof 20 of the truck trailer 10, as well as the corner post assemblies 174. The header 98 defines a generally "C-shaped" bracket, formed by a top surface 176 (shown in dashed lines in FIG. 4), a rear surface 178, and the bottom surface 168, thereby forming an open front section 179 toward a front of the truck trailer 10. The arrangement of the header 98 allows for the counterbalance assembly 18 to be easily installed from inside the truck trailer 10 through the open front section 179 at the front of the header 98.

The header 98 further includes sidewalls (not shown) at lateral ends thereof, shaft end supports 184, and the reinforcement members 172. The sidewalls are generally aligned with the sidewalls 16 of the truck trailer 10, such that a plane formed by the sidewalls is coplanar with a plane formed by the sidewalls 16. The shaft end supports 184 extend parallel to the sidewalls, inset slightly into the header 98, and include counterbalance shaft apertures 186. The counterbalance shaft apertures 186 are arranged forward of the reinforcement members 172 and are configured to receive the ends 140 of the shaft 132 of the counterbalance assembly 18. The shaft end supports 184 are additionally configured to engage the brackets 128 (shown in FIG. 3) of the counterbalance assembly 18.

Each of the reinforcement members 172 is disposed rearward of the counterbalance assembly 18 and forward of the rear surface 178. The reinforcement members 172 further extend transversely into the header 98 from corresponding sidewalls, toward a center of the header 98, generally perpendicular to the corresponding sidewalls. As such, the reinforcement members 172 are generally parallel to the rear surface 178 of the header 98. The reinforcement members 172 are additionally arranged opposite from one another, such that a plane formed by one of the reinforcement members 172 is coplanar with a plane formed by the other reinforcement member 172.

Each of the reinforcement members 172 further terminates short of the center of the header 98, such that an open space 188 remains between the reinforcement members 172. The open space 188 allows for the adjuster body 152 of the adjustment mechanism 130 to be directly mounted to the rear surface 178. Each of the reinforcement members 172 in the illustrated embodiment extend approximately 80 percent of a distance from the corresponding sidewall to the center of the header 98. In other embodiments, the reinforcement members 172 can extend farther, leaving just enough room between the two reinforcement members 172 to mount the adjustment mechanism 130 to the rear surface 178, or can extend less far to provide a larger open space 188 to allow two adjuster bodies of two independent adjustment mechanisms to be mounted to the rear surface 178, as will be described below. The reinforcement members 172 should, in any case, extend, from the corresponding sidewall, beyond an inner end 190 of a horizontal leg 192 of the forged foot angle 194 (best illustrated in FIG. 2) of the truck trailer 10 to ensure sufficient reinforcement.

As noted above, in some embodiments, the counterbalance assembly can include two independent counterbalance mechanisms. The counterbalance assembly can then counterbalance the door 22 in a manner similar to the counterbalance assembly 18. Utilizing separate counterbalance mechanisms can allow for simple adjustment of the counterbalance forces necessary to support the door 22. An example of a counterbalance assembly with two independent counterbalance mechanisms is disclosed in U.S. patent application Ser. No. 13/301,471 entitled HINGED BOTTOM ROLLER ASSEMBLY AND COUNTERBALANCE MECHANISM FOR OVERHEAD DOOR which was filed on Nov. 21, 2011, the entirety of which has been expressly incorporated by reference herein above. As such, a more detailed discussion of the structure and operation of such a counterbalance assembly can be found therein. However, it should be noted that such a counterbalance assembly would be situated similarly to the counterbalance assembly 18 described above, so that the vertical height 171 of the header 98 can similarly be minimized. In other illustrative embodiments, any number of counterbalance mechanisms may be utilized and/or the principles of the present disclosure may be utilized in conjunction with any suitable counterbalance mechanism.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Furthermore, it will be understood that the embodiments discussed above are presented as examples only, and that other embodiments are possible.

While the embodiments of the overhead door assembly 12, the counterbalance assembly 18, and the header 98 disclosed herein depict a door with a counterbalance assembly and header at a rear end of a truck trailer, the overhead door assembly, the counterbalance assembly, and/or the header 98 can be utilized on any other mobile or stationary storage enclosures and/or containers, as well as refrigerated and un-refrigerated trailers, storage containers, or truck bodies.

Thus, embodiments of the invention provide a truck trailer with an overhead door assembly which uses a counterbalance assembly to aid in opening and closing a door of the overhead door assembly. The improved truck trailer includes a reinforced header with a minimized vertical height, which may thereby allow for a height of a door opening of the overhead door assembly to be maximized.

The previous description of the disclosed embodiments is provided to enable any person skilled in the art to make or use the invention. Various modifications to these embodiments will be readily apparent to those skilled in the art, and the generic principles defined herein can be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A truck trailer comprising:

a sidewall;

an overhead door assembly including a door opening having a first height, at least one door panel moveable between an open position and a closed position, and a foot angle positioned at an upper corner of the door opening;

a counterbalance assembly configured to aid in moving the at least one door panel between an open position and a closed position; and a header disposed at a rear end of the truck trailer, the header having a second height and enclosing the counterbalance assembly, the header including a top surface, a rear surface coupled to a rear end of the top surface, a bottom surface coupled to a bottom end of the rear surface, and at least one reinforcement member disposed between the rear end of the truck trailer and the counterbalance assembly and forward of the rear surface and being coupled to the sidewall and at least one of the top surface or the bottom surface, the at least one reinforcement member extending transversely from the sidewall at least to an inner end of the foot angle and terminating short of a center of the header, the second height being less than 5% of the first.

2. The truck trailer of claim 1, wherein the second height is less than 4% of the first height.

3. The truck trailer of claim 1, wherein the at least one reinforcement member includes first and second reinforcement members, wherein each of the reinforcement members terminates short of the center of the header, such that an open space remains between the reinforcement members.

4. The truck trailer of claim 3, wherein the open space allows for the counterbalance assembly to be directly mounted to the rear surface of the header, wherein the reinforcement members and the mounting of the counterbalance assembly to the rear surface of the header provide reinforcement for the header to withstand a torsional force imposed thereon by the truck trailer during transit.

5. The truck trailer of claim 1, wherein:

the at least one reinforcement member includes first and second reinforcement members extending transversely from first and second sidewalls of the header toward a center of the header; and the header further includes first and second shaft support members positioned inwardly of the first and second sidewalls and extending generally transverse to the first and second reinforcement members, respectively.

6. The truck trailer of claim 5, wherein the counterbalance assembly further includes a shaft and first and second ends of the shaft are coupled to the first and second shaft support members, respectively.

7. The truck trailer of claim 1, wherein the top surface, the rear surface, and the bottom surface define a C-shaped bracket with an open front section opposite the rear surface.

8. The truck trailer of claim 1, wherein the at least one reinforcement member extending transversely from the sidewall a distance that is 80 percent of a total distance from the sidewall to a center of the header.

9. A truck trailer comprising:

first and second sidewalls;

an overhead door assembly including a door opening and at least one door panel moveable between an open position and a closed position;

first and second foot angles positioned at upper corners of the door opening;

a counterbalance assembly configured to aid in moving the at least one door panel between an open position and a closed position, the counterbalance assembly being supported by a shaft; and a header at a rear end of the truck trailer, the header enclosing the counterbalance assembly and including:

a top surface, a rear surface coupled to a rear end of the top surface, a bottom surface coupled to a bottom end of the rear surface, first and second reinforcement members disposed between the rear end of the truck trailer and the counterbalance assembly and forward of the rear surface, the first and second reinforcement members being coupled to one of the first and second sidewalls, respectively, and at least one of the top surface or the bottom surface, the first and second reinforcement members being substantially parallel to the rear surface and each extending transversely from one of the first and second sidewalls, past an inner end of one of the first and second foot angles, toward a center of the header and each terminating short of the center of the header, and first and second shaft support members coupled to and spaced inwardly from ends of the bottom surface and substantially perpendicular to the rear surface, first and second ends of the shaft being coupled to the first and second shaft support members, respectively.

10. The truck trailer of claim 9, wherein the first and second reinforcement members each terminate short of the center of the header, such that an open space remains between the reinforcement members.

11. The truck trailer of claim 10, wherein the open space allows for the counterbalance assembly to be directly mounted to the rear surface of the header, wherein the reinforcement members and the mounting of the counterbalance assembly to the rear surface of the header provide reinforcement for the header to withstand a torsional force imposed thereon by the truck trailer during transit.

12. The truck trailer of claim 9, wherein a vertical height of the header is less than 4% of a height of the door opening.

13. The truck trailer of claim 9, further including an aperture in the bottom surface, the aperture sized and configured to accept a head of an adjuster that is configured to adjust a worm gear that interacts with an adjustment mechanism of the counterbalance assembly.

14. A header for enclosing a counterbalance assembly for use with an overhead door assembly of a truck trailer, the header comprising:

a top surface;

a rear surface coupled to a rear end of the top surface and configured to be positioned adjacent an upper rear wall of the truck trailer above a door opening of the truck trailer;

a bottom surface coupled to a bottom end of the rear surface; and at least one reinforcement member disposed rearward of the counterbalance assembly and forward of the rear surface and being coupled to a sidewall of the header and at least one of the top surface or the bottom surface, the at least one reinforcement member providing reinforcement to the header by extending from the sidewall of the header past an inner end of a foot angle positioned in a corner of the door opening and terminating short of a center of the header.

15. The header of claim 14, wherein the at least one reinforcement member includes first and second reinforcement members extending transversely from first and second sidewalls of the header toward the center of the header.

16. The header of claim 15, wherein each of the reinforcement members terminates short of the center of the header, such that an open space remains between the reinforcement members.

17. The header of claim 16, in combination with the counterbalance assembly positioned forward of the two reinforcement members with an adjustment mechanism of the counterbalance assembly positioned within the open space.

18. The header of claim 17, wherein a portion of the adjustment mechanism is directly mounted to the rear surface of the header.

19. The header of claim 16, further including first and second shaft support members positioned inwardly of the first and second sidewalls and extending generally transverse to the first and second reinforcement members, respectively.

20. The header of claim 19, wherein the counterbalance assembly further includes a shaft and first and second ends of the shaft are coupled to the first and second shaft support members, respectively.

* * * * *